US005902501A

United States Patent [19]

Nunnally et al.

[11] Patent Number: 5,902,501

[45] Date of Patent: May 11, 1999

[54] LIGHTER ACTUATION SYSTEM

[75] Inventors: H. Neal Nunnally, Richmond; Dave E. Sharpe, Chesterfield; Michael L. Watkins, Chester, all of Va.; Douglas J. Ely, Andover; Neal R. Butler, Acton, both of Mass.; Patrick J. Cobler, Nashua, N.H.

[73] Assignee: Philip Morris Incorporated, New York, N.Y.

[21] Appl. No.: 08/953,945

[22] Filed: Oct. 20, 1997

[51] Int. Cl.[6] ..... F23Q 7/00

[52] U.S. Cl. ..... 219/263; 219/269

[58] Field of Search ..... 219/260, 262, 219/263, 264, 265, 267, 269, 270, 386, 600; 200/61.59

[56] References Cited

U.S. PATENT DOCUMENTS

| | | | |
|---|---|---|---|
| 2,199,885 | 5/1940 | Kravchuk | 219/263 |
| 2,525,040 | 10/1950 | Luthi | 219/263 |
| 3,372,306 | 3/1968 | Koizumi | 219/263 |
| 3,379,856 | 4/1968 | Hirsch | 219/260 |
| 3,419,704 | 12/1968 | Hunt | 219/260 |
| 5,613,505 | 3/1997 | Campbell et al. | 219/600 |

FOREIGN PATENT DOCUMENTS

| | | |
|---|---|---|
| 5-248635 | 9/1993 | Japan . |

*Primary Examiner*—Tu B. Hoang
*Attorney, Agent, or Firm*—Charles E. B. Glenn; James E. Schardt; James T. Moore

[57] ABSTRACT

The present invention provides a cigarette identifier system comprising a coil at a location along the cigarette-receiving receptacle of the lighter, an oscillation circuit in communication with the coil and a controller configured to activate or deactivate the lighter responsively to output of the oscillator circuit.

18 Claims, 9 Drawing Sheets

LIGHTER ACTUATION SYSTEM

FIELD OF INVENTION

This invention relates to electrically powered smoking systems, and more particularly to lighters of electrically powered smoking systems and their actuators which prepare them for operation.

BACKGROUND OF THE INVENTION

Commonly assigned, U.S. Pat. Nos. 5,388,594, 5,505,214, and 5,591,368 disclose various electrically powered smoking systems comprising electric lighters and cigarettes. The systems provide smoking pleasure while significantly reducing sidestream smoke and permitting the smoker to selectively suspend and reinitiate smoking.

The preferred embodiment of the lighter in U.S. Pat. No. 5,388,594 includes a plurality of metallic serpentine heaters disposed in a configuration that slidingly receives a tobacco rod portion of the system's cigarette. The cigarette and the lighter are configured such that when the cigarette is inserted into the lighter and as individual heaters are activated for each puff, localized charring occurs at spots about the cigarette in the locality where each heater bears against the cigarette (hereinafter referred to as a "heater footprint").

In U.S. Pat. No. 5,388,594, the sequence and the amount of energy applied to each heater element during a puff cycle is regulated by a logic circuit of a controller which executes a power subroutine upon its receiving a signal from a puff sensor. The power subroutine includes the steps of reading the voltage of the power source (batteries) at the initiation of the puff and resolving a shut-off signal in cooperation with a constant Joules energy timer such that the duration of the pulse (its cycle-period) is adjusted relative to the voltage of the power source to provide the same total amount of energy (Joules) throughout the range of voltages of the battery discharge cycle.

Commonly assigned U.S. Pat. Nos. 5,388,594, 5,505,214, and 5,591,368 disclose cigarette designs including a tubular, tobacco-coated web that releases tobacco smoke constituents when heat is applied to the web. Preferably, the tobacco is coated along the interior of the web, and the web includes an unfilled portion or cavity so as to promote a more complete development of tobacco aerosol. The various forms of cavities (also called gaps and voids) improve delivery in electrically heated cigarettes.

U.S. Pat. No. 5,591,368 describes an electrical smoking system comprising an electric lighter having a plurality of electrically resistive heaters and a controller, together with a cigarette having a tubular tobacco web which is only partially-filled with cut tobacco shreds so as to define a filled tobacco rod portion and an unfilled tobacco rod portion. Preferably upon full insertion of the cigarette into the lighter, operative portions of heater elements within the lighter partially overlap both the aforementioned filled portion and the unfilled portion of the cigarette rod. With such overlap, an immediate release of tobacco smoke arises from the more readily combusted, unfilled tobacco rod portion so that the smoker receives an immediate response upon initiating a draw. Combustion of the filled tobacco rod portion is slightly delayed and contributes the aromas and taste of the tobacco or blend of tobaccos comprising the filled portion of the tobacco rod. Accordingly, the arrangement provides a smoker aspects of smoking pleasure to which he/she expects from smoking more traditional cigarettes; an immediacy of response and the tastes and aromas of filler tobaccos.

With the system of U.S. Pat. No. 5,591,368, it is important that the internal structures of the cigarette and lighter are match so that the desired proportions of heater overlap are achieved. Accordingly, a need has arisen for providing the lighter a capacity to discern whether a given cigarette that has been inserted in the lighter has the desired internal structure, particularly as to whether the cigarette includes a cavity within a tubular tobacco web. Further to this need, it is important that the cigarette and lighter of an electrical smoking system be matched so that the desired tastes and predetermined delivery levels are obtained.

The above-commonly assigned U.S. Pat. Nos. 5,388,594, 5,505,214, and 5,591,368 all disclosed systems which include a cigarette detector signal a logic circuit responsively to an insertion of a cigarette, some of which detectors include optical components. It has been found that lens and other light transmissive components located at or about the heater elements of the lighter are prone to collect dirt and/or tobacco smoke condensates and become clouded.

It has also been found that optical detectors may generate spurious signals if they are exposed to ambient (external) sources of light. This problem becomes aggravated as one attempts to locate such detectors away from the heater elements and closer to the entrance of the cigarette receiving port of the lighter.

OBJECTS AND SUMMARY OF INVENTION

Accordingly, an object of the present invention is to provide a cigarette identifier mechanism in an electrical smoking system which is capable of distinguishing a cavity-bearing cigarette from a more traditional cigarette.

Another object of the present invention is to provide a cigarette identifier system that has the capacity to operate adjacent an electrical heater fixture.

Still another object of the present invention is to provide a cigarette identifier system that is not vulnerable to smoke condensates and dirt.

Another object of the present invention is to provide a cigarette identifier system that is not vulnerable to interference from ambient light.

Still another object of the present invention is to provide a cigarette identifier system which is operable within the compact confines of a hand-held electrical lighter.

These and other objects are achieved with the present invention which provides an electrical smoking system whose lighter includes a cigarette identifier system which is configured to recognize an inductive marker provided in the cigarette, preferably of a partially-filled cigarette.

More particularly, the present invention provides a cigarette identifier system comprising a coil at a location along the cigarette-receiving receptacle of the lighter, a driven oscillating circuit in communication with the coil and a controller configured to activate or deactivate the lighter responsively to output of the oscillator circuit.

Another aspect of the present invention is provision within a partially filled cigarette of an inductive marker component comprising a metallic foil or alternatively, a capacitive ink or tape.

BRIEF DESCRIPTION OF THE DRAWING

These and other objects, advantages and novel features of the present invention will become apparent from the following detailed description of the preferred embodiments of the present invention when considered in conjunction with the accompanying drawing, in which.

DETAILED DESCRIPTION OF THE PREFERRED EMBODIMENTS

Figure 1:
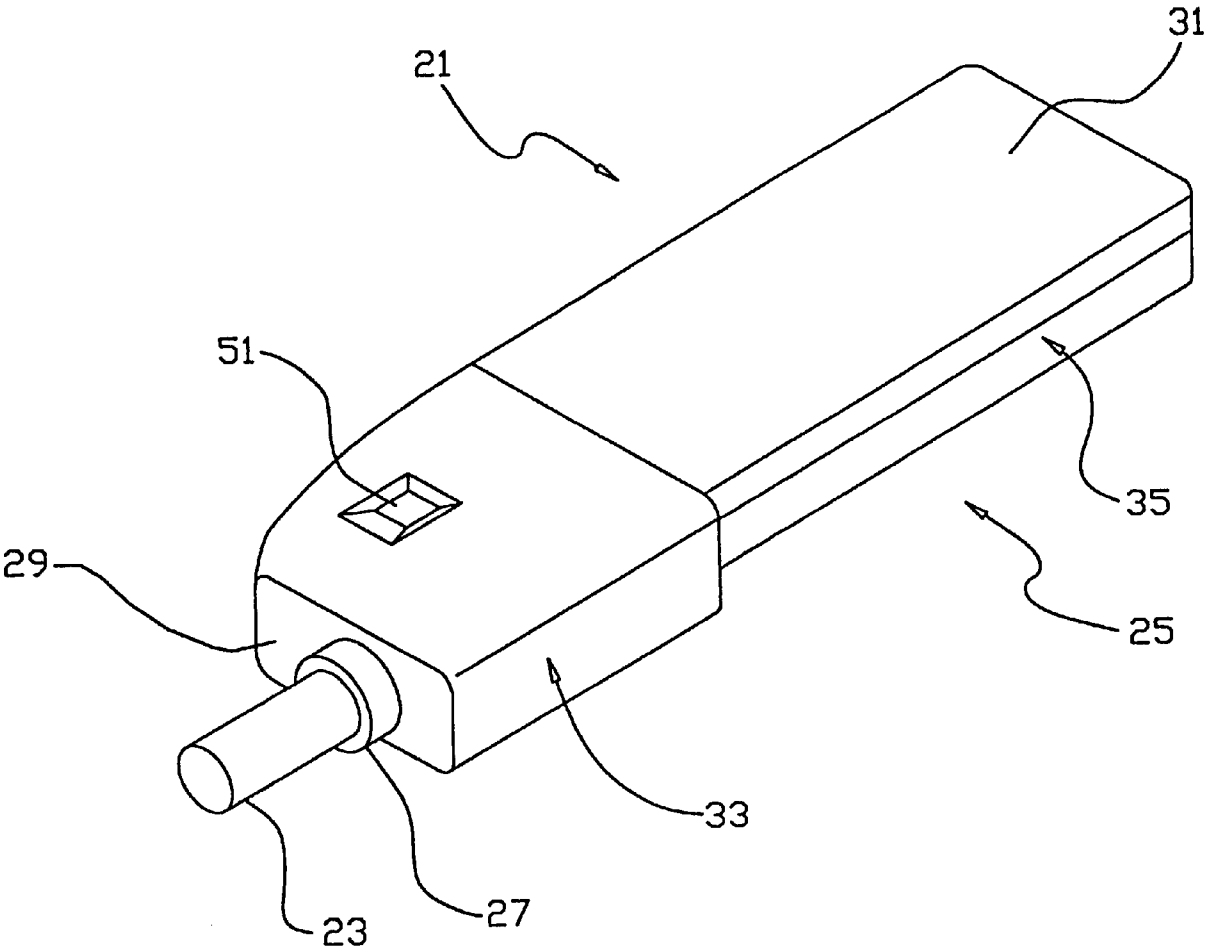
FIG. 1 is a perspective view of a smoking system in accordance with a preferred embodiment of the present invention with a cigarette of the system inserted into the electrically operated lighter.
Figure 2:
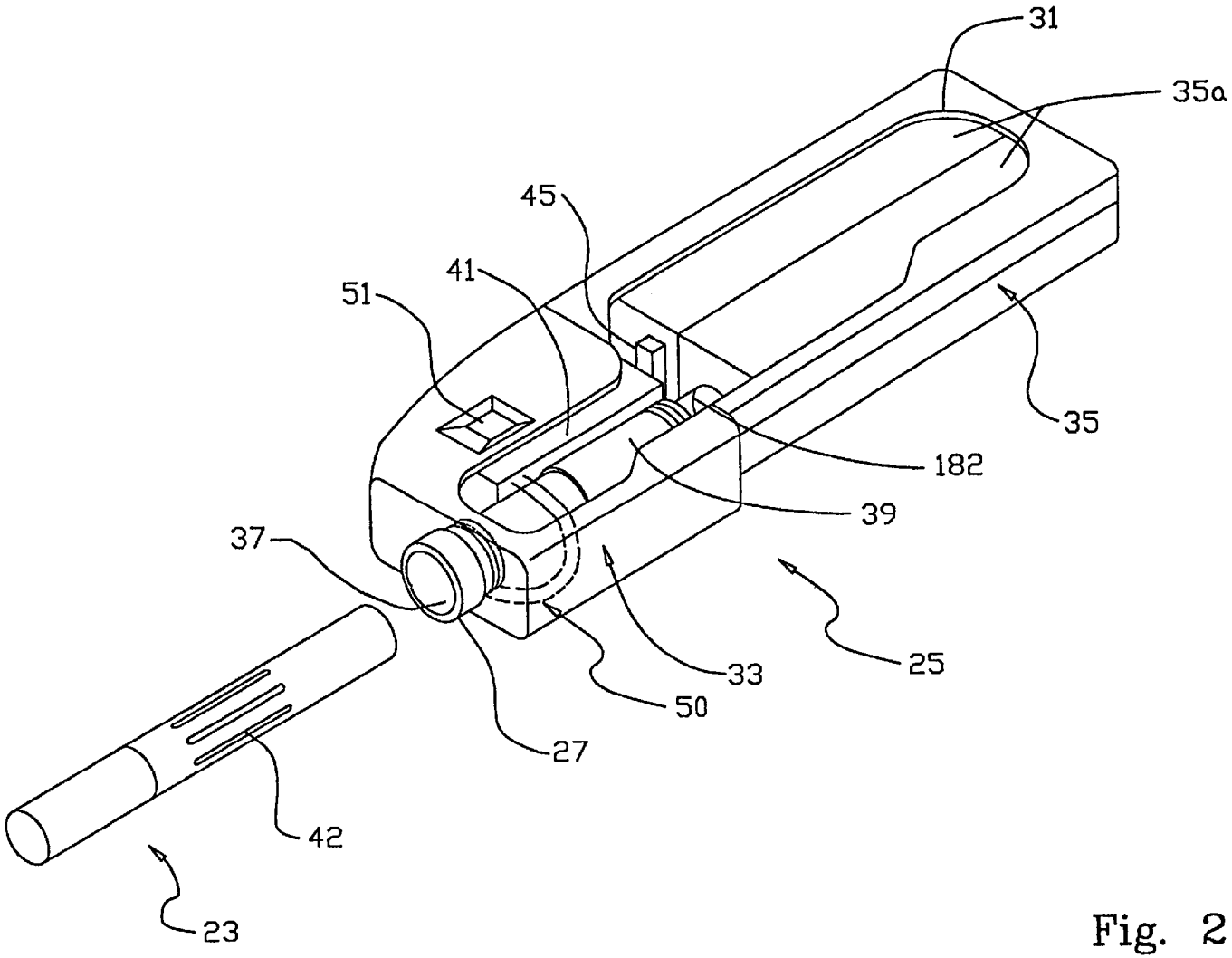
FIG. 2 is a perspective view of the smoking system of FIG. 1, but with the cigarette withdrawn from the lighter upon conclusion of a smoking.

Referring to FIGS. 1 and 2, a preferred embodiment of the present invention provides a smoking system 21 which preferably includes a partially-filled, filter cigarette 23 and a reusable lighter 25. The cigarette 23 is adapted to be inserted into and removed from an annular cigarette receiver 27 which is located at a front end portion 29 of the lighter 25. Once the cigarette 23 has been inserted, the smoking system 21 is used in much the same fashion as a more traditional cigarette, but without lighting or smoldering. The cigarette 23 is discarded after one or more puff cycles. Preferably, each cigarette 23 provides a total of eight puffs (puff cycles) or more per smoke; however it is a matter of design expedient to adjust to a lesser or greater total number of available puffs.

Further particulars of the smoking system is described also in the commonly assigned, U.S. Pat. Nos. 5,388,594; 5,505,214; 5,591,368 and 5,499,636, all which are hereby incorporated by reference in their entireties.

The lighter 25 includes a housing 31 having front and rear housing portions 33 and 35. One or more batteries 35*a* are removably located within the rear housing portion 35 and supply energy to a heater fixture 39 which includes a plurality of electrically resistive, heating elements 37 (also shown in FIG. 3A). The heating elements 37 are arranged within the front housing portion 33 to slidingly receive the cigarette 23. A stop 182 is provided at a base portion of the heater fixture 39 which assures that full inserted cigarettes 23 are placed consistently relative to the heating elements 37. The cigarette receiver 27, the heating elements 37 and the stop 182 cooperatively establish a cigarette receptacle space 127 for receiving a cigarette 23.

A control circuit 41 in the front housing portion 33 selectively establishes electrical communication between the batteries 35*a* and one or more the heater elements 37 during execution of each puff-actuated power cycle. The preferred embodiment of the present invention includes a cigarette identifier system 50 capable of discerning when a partially-filled filter cigarette 23 is inserted into the lighter 25. Once detection occurs, the control circuit 41 readies the lighter for puff-actuated operation. In the absence of any detection activity, the control circuit 41 maintains the lighter in an energy conserving, dormant mode. Aspects of the cigarette identifier system 50 will be detailed in the description which follows.

Still referring to FIGS. 1 and 2, preferably the rear portion 35 of the lighter housing 31 is adapted to be readily opened and closed, such as with screws or snap-fit components, so as to facilitate replacement of the batteries. If desired, an electrical socket or contacts may be provided for recharging the batteries in a charger supplied with house current or the like. Preferably, the front housing portion 33 is removably joined to the rear housing portion 35, such as with a dovetail joint or a socket fit.

The batteries 35*a* are sized to provide sufficient power for the heaters 37 to function as intended and preferably comprise a replaceable and rechargeable type. Alternate sources of power are suitable, such as capacitors. In the preferred embodiment, the power source comprises four nickel-cadmium battery cells connected in series with a total, non-loaded voltage in the range of approximately 4.8 to 5.6 volts. The characteristics of the power source are, however, selected in view of the characteristics of other components in the smoking system 21, particularly the characteristics of the heating elements 37. Commonly assigned U.S. Pat. No. 5,144,962, hereby incorporated by reference, describes several types of power sources useful in connection with the smoking system of the present invention, such as rechargeable battery sources and power arrangements which comprise a battery and a capacitor which is recharged by the battery.

Referring specifically to FIG. 2, preferably, once the circuitry 41 receives the proper signal from the cigarette identifier 50, it is ready to execute power cycles upon receipt of further signals from the puff-actuated sensor 45 that is sensitive to either changes in pressure or changes in rate of air flow that occur upon initiation of a draw on the cigarette 23 by a smoker. The puff-actuated sensor 45 is preferably located within the front housing portion 33 of the lighter 25 and is communicated with the cigarette receptacle 127 of the heater fixture 39 via a port extending through a stop 182 located at the base of the heater fixture 39. A puff-actuated sensor 45 suitable for use in the smoking system 21 is described in commonly assigned U.S. Pat. No. 5,060,671 and U.S. Pat. No. 5,388,594, the disclosures of which are incorporated herein by reference.

The puff sensor 45 preferably comprises a Model 163PCO1D35 silicon sensor, manufactured by the MicroSwitch division of Honeywell, Inc., Freeport, Ill. Flow sensing devices, such as those using hot-wire anemometry principles, have also been successfully demonstrated to be useful for actuating an appropriate one of the heater elements 37 upon detection of a change in air flow. Once actuated by the sensor 45, the control circuitry 41 directs electric current to an appropriate one of the heater elements 37.

Figure 3A:
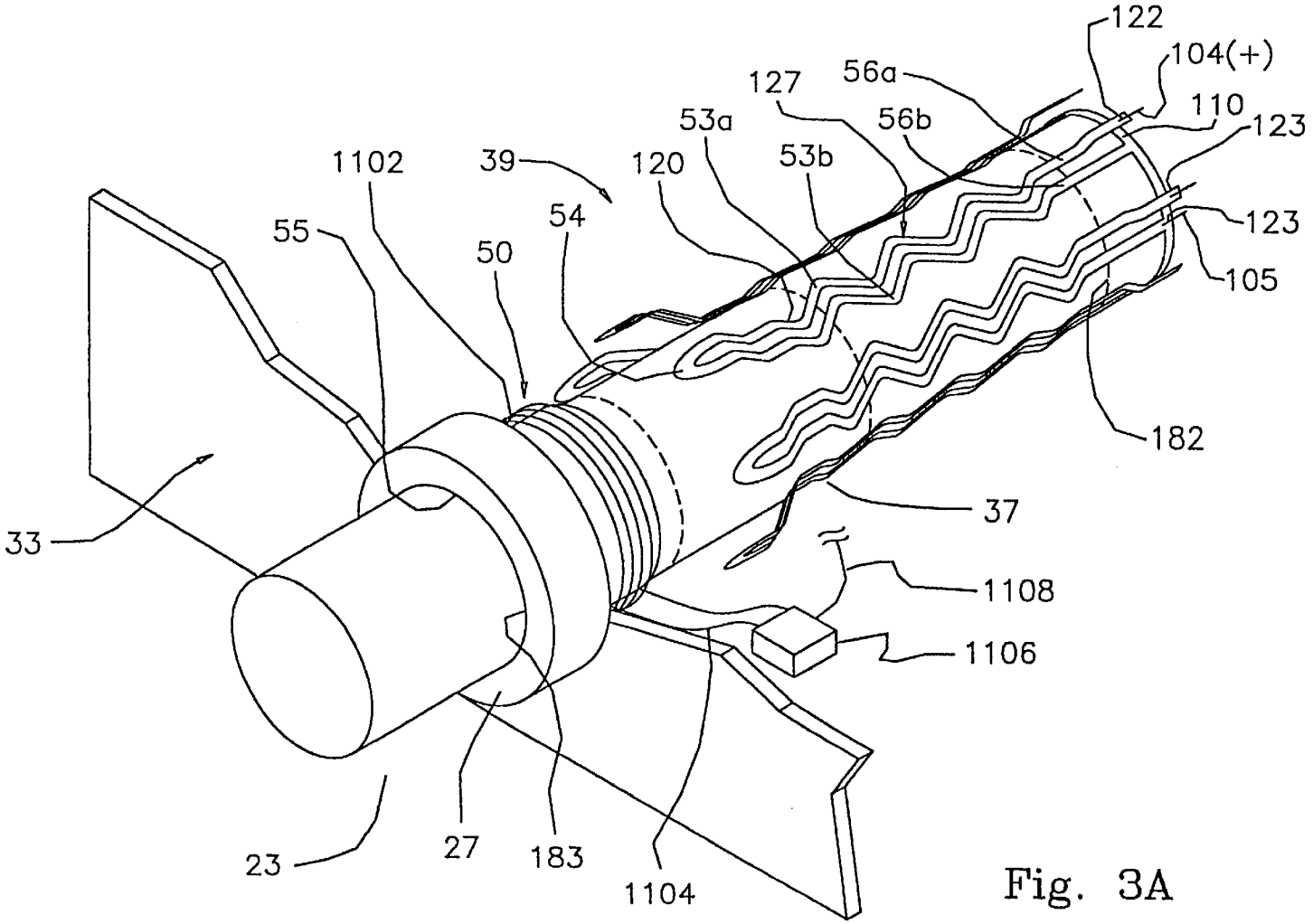
FIG. 3A is a partial, perspective detail view of a preferred embodiment of the heater fixture of FIG. 1, including wavy hairpin heater elements and portions of a preferred cigarette identifier system.
Figure 3B:
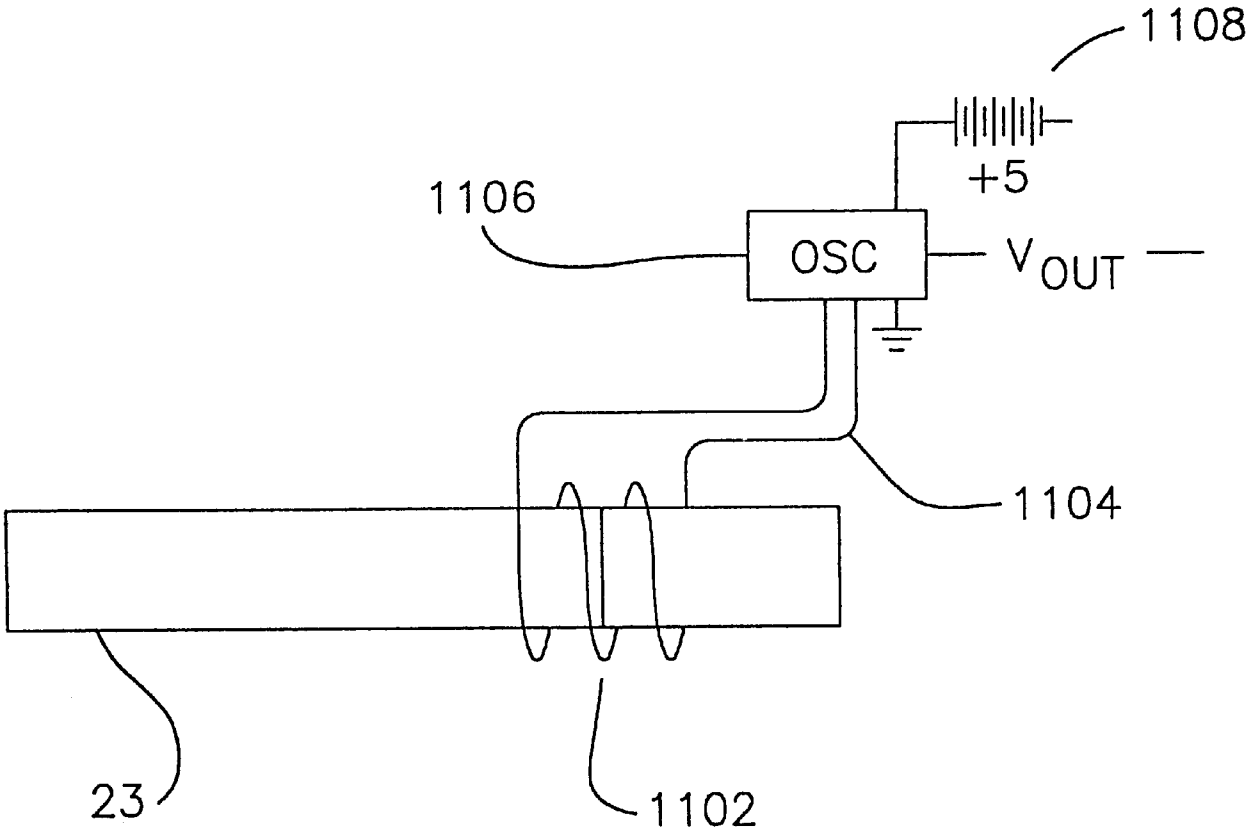
FIG. 3B is a schematic of the preferred cigarette identifier system shown in FIG. 3A.

Referring now to FIGS. 3A and 3B, the preferred cigarette identifier system 50 includes a coil 1102 disposed concentrically about a location along the cigarette receiver 27, and an oscillator circuit 1106 which can be integrated into the control circuit 41 or more preferably, is arranged as a separate electronic element located adjacent the coil 1102. Peferably, the induction coil 1102 comprises approximately 15 to 25 windings or turns, more preferably approximately 20 turns, of 20 to 40 gauge wire, more preferably approximately 30 gauge wire. Electrical leads 1104 connect the coil 1102 with the oscillator circuit 1106.

The oscillator circuit 1106 is connected to the batteries 35*a* through the control circuit 41 at a suitable connection 1108 and provides an output signal ($v_{id}$) to the control cicuit 41 though leads 112.

An indicator 51 is provided at a location along the exterior of the lighter 25, preferably on the front housing portion 33, to indicate the number of puffs remaining in a smoke of a cigarette 23. The indicator 51 preferably includes a seven-segment liquid crystal display. In the preferred embodiment, the indicator 51 is caused to display the digit "8" upon cigarette identifier system 50 detecting the presence of a partially-filled cigarette 23 in the heater fixture 39. Preferably, the cigarette identifier system 50 is arranged to provide a signal to the circuitry 41 which, in turn, responsively provides a signal to the indicator 51 and readies the puff sensor 45. The display of the digit "8" on the indicator 51 reflects that the eight puffs provided on each cigarette 23 are available, i.e., no puff cycle has been undertaken and none of the heater elements 37 have been activated to heat the cigarette 23. After the cigarette 23 is fully smoked, the indicator displays the digit "0". When the cigarette 23 is removed from the lighter 25, the cigarette identifier system 50 no longer detects a presence of a cigarette 23 and the indicator 51 is turned off.

In the alternative to displaying the remainder of the puff count, the detector display may instead be arranged to indicate whether the system is active or inactive ("on" or "off").

Power sources, circuitry, puff-actuated sensors, and indicators useful with the smoking system 21 of the present invention are described in commonly assigned, U.S. Pat. Nos. 5,060,671; 5,388,594 and 5,591,368, all which are incorporated herein by reference.

Referring now to FIG. 3A, the front housing portion 33 of the lighter 25 encloses a substantially cylindrical heater fixture 39 whose heater elements 37 slidingly receive the cigarette 23. The heater fixture 39 is adapted to support an inserted cigarette 23 in a fixed relation to the heater elements 37 such that the heater elements 37 are positioned alongside the cigarette 23 at approximately the same location along each newly inserted cigarette 23. In the preferred embodiment, the heater fixture 39 includes eight mutually parallel heater elements 37 which are disposed concentrically about the axis of symmetry of the cigarette receiver 27. The locations where each heater element 37 bears against (or is in thermal communication with) a fully inserted cigarette 23 is referred to herein as the heater footprint.

Preferably the heater elements 37 are of a design referred to herein as a wavy hairpin heater element 37, wherein each heater element 37 includes at least first and second serpentine, elongate members 53*a* and 53*b* which are adjoined at an end portion (tip) 54. The tips 54 are adjacent the opening 183 of the cigarette receiver 27. The opposite ends 56*a* and 56*b* of each heater element 37 are electrically connected to the opposite poles of the power source 35*a* as selectively established by the controller 41. More specifically, an electrical pathway through each heater fixture 37 is established, respectively, through a terminal pin 104, a connection 122 between the pin 104 and a free end portion 56*a* of one of the serpentine members 53*a*, through at least a portion of the tip 54 to the other serpentine member 53*b* and its end portion 56*b*. Preferably, an integrally formed, common connection ring 110 provides a common electrical connection amongst all the end portions 56*b* of the elongate member 53*b*. In the preferred embodiment, the ring 110 is connected to the positive terminal of the power source 35*a* (or common) through a connection 123 between the ring 110 and a pin 105. Further details of the construction and establishment of electrical connections in the heater fixture 39 are illustrated and described in the commonly assigned U.S. Pat. Nos. 5,060,671; 5,388,594 and 5,591,368, all which are incorporated herein by reference.

Additional heater fixtures 37 that are operable as part of the lighter 25 include those disclosed in commonly assigned, U.S. Pat. No. 5,665,262; and commonly assigned, U.S. Pat. No. 5,498,855, all which patents are incorporated herein by reference in their entireties.

Preferably, the heaters 37 are individually energized by the power source 35*a* under the puff-actuated control of the circuitry 41 to heat the cigarette 23 preferably eight times at spaced locations about the periphery of the cigarette 23. The heating renders eight puffs from the cigarette 23, as is commonly achieved with the smoking of a more traditional cigarette. It may be preferred to activate more than one heater simultaneously for one or more or all of the puffs.

Figure 4:
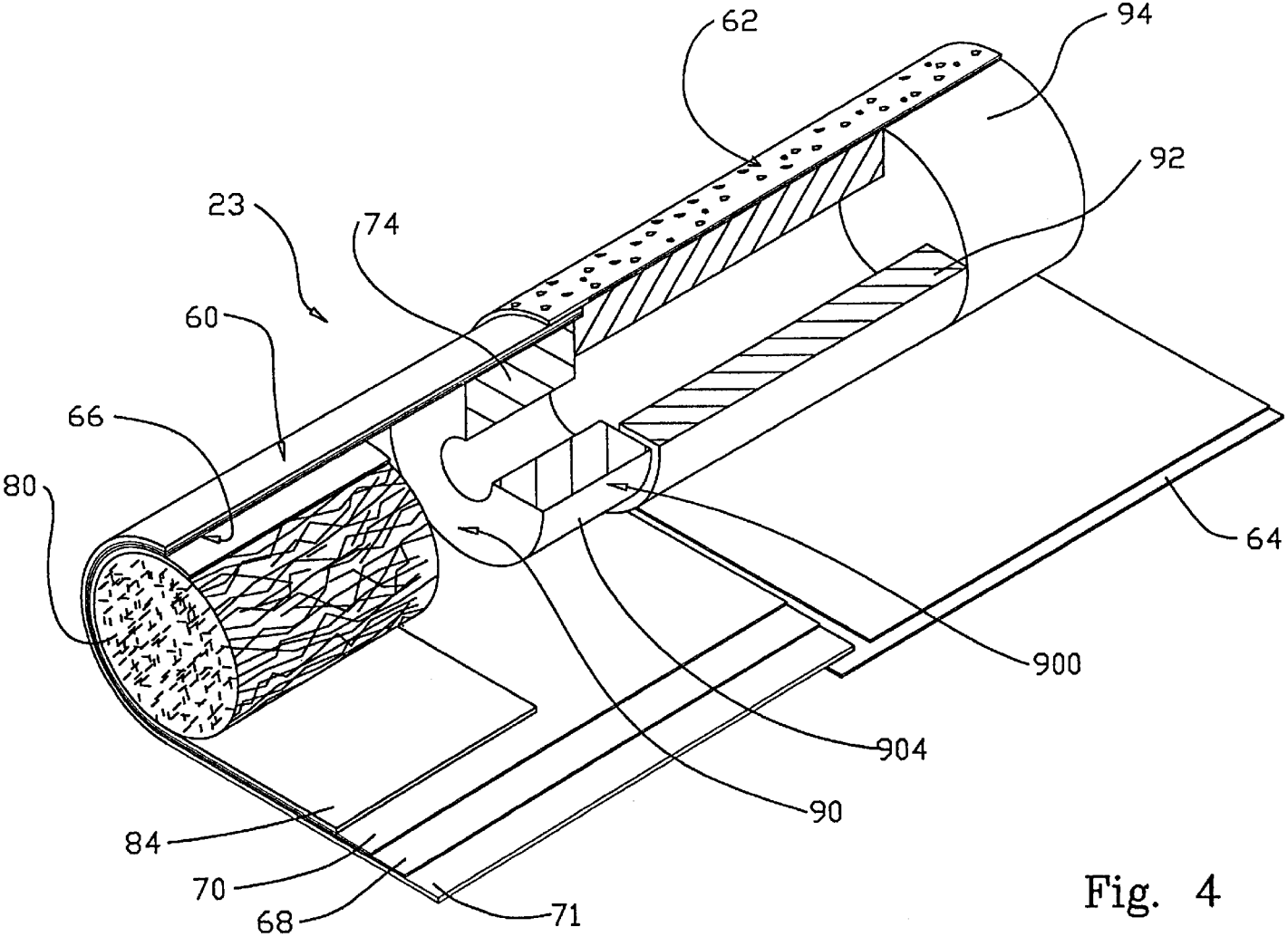
FIG. 4 is a perspective, partial exploded view of a preferred embodiment of the partially-filled cigarette shown in FIG. 1, including an inductive marker.

Referring now to FIG. 4, the cigarette 23 preferably comprises a tobacco rod 60 and a filter tipping 62, which are preferably joined together with tipping paper 64.

The tobacco rod 60 of the cigarette 23 preferably includes a tobacco web 66 which has been folded into a tubular (cylindrical) form about a free-flow filter 74 at one of its ends and a tobacco plug 80 at the other. In the alternative, a plug of cellulose acetate might be used in place of the tobacco plug 80.

An overwrap 71 is intimately enwrapped about the tobacco web 66 and is held together along a longitudinal seam as is common in construction of more traditional cigarettes. The overwrap 71 retains the tobacco web 66 in a wrapped condition about a free-flow filter 74 and a tobacco plug 80.

The tobacco web 66 itself preferably comprises a base web 68 and a layer of tobacco flavor material 70 located along the inside surface of the base web 68. At the tipped end 72 of the tobacco rod 60, the tobacco web 66 together with the overwrap 71 are wrapped about the tubular free-flow filter plug 74. Preferably, the tobacco plug 80 is constructed separately from the tobacco web 66 and comprises a relatively short column of cut filler tobacco that preferably has been wrapped within and retained by a plug wrap 84.

As a general matter, the length of the tobacco plug 80 is preferably set relative to the total length of the tobacco rod 60 such that a void (or "cavity") 90 is established along the tobacco rod 60 between the free-flow filter 74 and the tobacco plug 80. The void 90 corresponds to an unfilled portion of the tobacco rod 60 and is in immediate fluid communication with the tipping 62 through the free flow filter 74 of the tobacco rod 60.

The tipping 62 preferably comprises a free-flow filter 92 located adjacent the tobacco rod 60 and a mouthpiece filter plug 94 at the distal end of the tipping 62 from the tobacco rod 60. Preferably, the free-flow filter 92 is tubular and transmits air with very little pressure drop. Other low efficiency filters of standard configuration could be used instead, however. The inside diameter for the free flow filter 92 is preferably at or between 2 to 6 millimeters and is preferably greater than that of the free flow filter 74 of the tobacco rod 60.

The mouthpiece filter plug 104 closes off the free end of the tipping 62 for purposes of appearance and, if desired, to effect some filtration, although it is preferred that the mouthpiece filter plug 104 comprise a low efficiency filter of preferably about 15 to 25 percent efficiency.

Further detailed description of this type of cigarette may be found in commonly assigned U.S. Pat. No. 5,499,636, which is hereby incorporated by reference in its entirety.

The cigarette 23 for use in an apparatus according to the present invention further includes includes an inductive marker 900 preferably comprising a foil plug wrap 904 disposed about the free flow filter plug 94. Preferably, the foil plug wrap 904 is in the range of approximately 0.00005 to 0.001 inches thick, more preferably from about 0.00025 to about 0.0005 inches thick, most preferably approximately 0.0005 inches thick. The foil plug wrap 904 may optionally comprise a laminate of foil as previously described and a layer of traditional plug wrap material.

Figure 5:
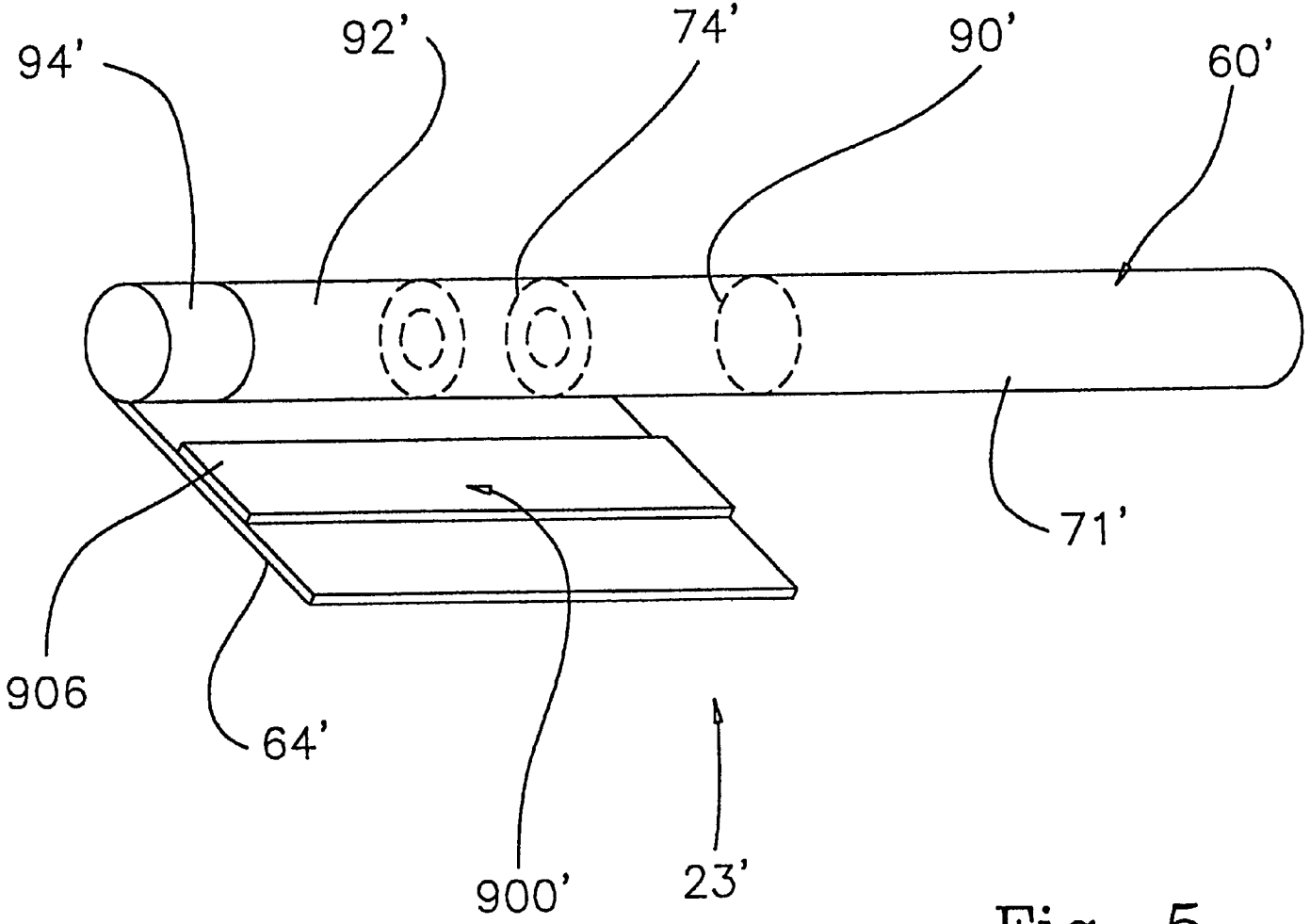
FIG. 5 is a perspective, partially exploded view of another preferred embodiment of the partially-filled cigarette shown in FIG. 1, including an alternate inductive marker.

Referring now to FIG. 5, in the alternative, the inductive marker 900' of a cigarette 23' may comprise instead a stripe or layer of metallic, magnetic or inductive ink 906, preferably disposed along an inside surface of the plug wrap 64'. The ink 906 may be applied to selected portions of the plug wrap 64' or cover the entirety of its inside surface. In the alternative, the ink 906 may be applied to other components of the cigarette 23', such as its first free-flow filter 74', the second free-flow filter 92' or portions of the wrapper 71' adjacent the free-flow filter 74'.

It is apparent that various applications of foils, inks or metallic elements such metallized tapes, magnetized tapes or rods may be selected to establish an inductive marker 900 within a given cigarette design to interact with the coil 1102 of the oscillator circuit 1106 for product identification as will be explained in the description which follows. Furthermore, although the inked stripe 906 in FIG. 5 is shown as extending longitudinally, the stripe, tape or metallic element instead might be extended circumferentially so as to form a loop at a location along the the cigarette 23'.

Figure 6:
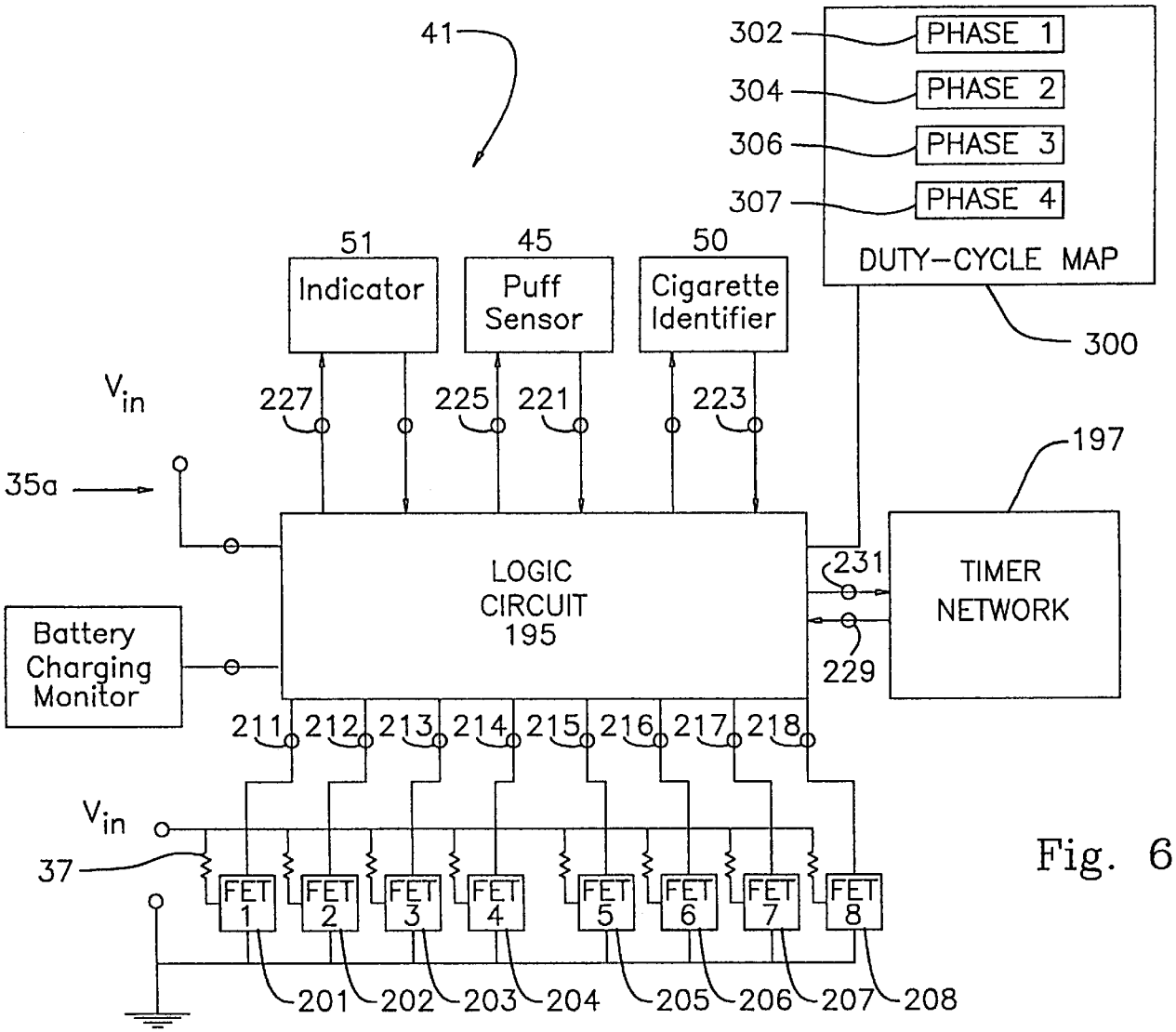
FIG. 6 is a schematic, block-diagram of a preferred control circuit of the lighter shown in FIGS. 1 and 2.

Referring now to FIGS. 2 and 6, the electrical control circuit 41 of the lighter 25 includes a logic circuit 195, which preferably comprises a micro-controller or an application specific, integrated circuit (or "ASIC"). The logic circuit 195 is communicated through the control circuit 41 with the cigarette identifier system 50; the puff sensor 45 for detecting a draw upon the inserted cigarette 23; the LCD indicator 51 for indicating the number of puffs remaining on a cigarette; the power source 37; and a timing network 197.

The logic circuit 195 may comprise any conventional circuit capable of implementing the functions discussed herein. A field-programmable gate array (e.g., a type ACTEL A1280A FPGA PQFP 160, available from Actel Corporation, Sunnyvale, Calif.) or a micro controller can be programmed to perform the digital logic functions with analog functions performed by other components. An ASIC or micro-controller can perform both the analog and digital functions in one component. Features of control circuitry and logic circuitry similar to the control circuit 41 and logic circuit 195 of the present invention are disclosed, for example, in commonly assigned, U.S. Pat. Nos. 5,388,594; 5,505,214; 5,591,368; and 5,499,636, all which are hereby incorporated by reference in their entireties. Further details are also provided in the copending, commonly assigned U.S. application Ser. No. 08/755,044 filed Oct. 22, 1996.

In the preferred embodiment, eight individual heater elements 37 are connected to a positive terminal of the power source 35*a* and to ground through corresponding field effect transistor (FET) heater switches 201–208. Individual (or selected) ones of the heater switches 201–208 will turn on under control of the logic circuit 195 through terminals 211–218, respectively, during execution of a power cycle by the logic circuit 195. The logic circuit 195 provides signals for activating and deactivating particular ones of the heater switches 201–208 to activate and deactivate the corresponding heater element 37 of the heater fixture 39.

The logic circuit 195 cooperates with the timing circuit 197 to precisely execute the activation and deactivation of each heater element 37 in accordance with a predetermined total cycle period ("$t_{total}$") and to precisely divide each total cycle period into a predetermined number of phases, with each phase having its own predetermined period of time ("$t_{phase}$"). In the preferred embodiment, the total cycle period total has been selected to be 1.6 seconds (so as to be less than the two-second duration normally associated with a smoker's draw upon a cigarette, plus provision for margin) and the total cycle period total is divided preferably into two phases, a first phase having a predetermined time period ("$t_{phase}$ 1") of 1.0 seconds and a second phase having a predetermined time period ("$t_{phase}$ 2") of 0.6 seconds. The total cycle period total, the total number of phases and the respective phase periods are parameters, among others, that are resolved in accordance with the teachings which follow for establishing within the control circuit 41, a capacity to execute a power cycle that precisely duplicates a preferred thermal interaction ("thermal profile" or "thermo-histogram") between the respective heater element 37 and adjacent portions of the cigarette 23. Additionally, once the preferred thermo-histogram is established, certain parameters (preferably, duty cycles within each phase) are adjusted dynamically by the control circuit 41 so as to precisely duplicate the predetermined thermo-histogram with every power cycle throughout the range of voltages $v_{in}$ encompassed by the aforementioned battery discharge cycle.

The puff-actuated sensor 45 supplies a signal to the logic circuit 195 that is indicative of smoker activation (i.e., a continuous drop in pressure or air flow over a sufficiently sustained period of time). The logic circuit 195 includes a debouncing routine for distinguishing between minor air pressure variations and more sustained draws on the cigarette to avoid inadvertent activation of heater elements in response to errant signal from the puff-actuated sensor 45. The puff-actuated sensor 45 may include a piezoresistive pressure sensor or an optical flap sensor that is used to drive an operational amplifier, the output of which is in turn used to supply a logic signal to the logic circuit 195. Puff-actuated sensors suitable for use in connection with the smoking system include a Model 163PC01D35 silicon sensor, manufactured by the MicroSwitch division of Honeywell, Inc., Freeport, Ill., or a type NPH-5-02.5G NOVA sensor, available from Lucas-Nova, Freemont, Calif., or a type SLP004D sensor, available from SenSym Incorporated, Sunnyvale, Calif.

In order to conserve energy, it is preferred that the puff-actuated sensor 45 be cycled on and off at low duty cycles (e.g., from about a 2 to 10% duty cycle). For example, it is preferred that the puff actuated sensor 45 be turned on for a 1 millisecond duration every 10 milliseconds. If, for example, the puff actuated sensor 45 detects pressure drop or air flow indicative of a draw on a cigarette during four consecutive pulses (i.e., over a 40 millisecond period), the puff actuated sensor sends a signal through a terminal 221 to the logic circuit 195. The logic circuit 195 then sends a signal through an appropriate one of the terminals 211–218 to turn an appropriate one of the FET heater switches 201–208 ON.

Output of the cigarette identifier system 50 is directed through a terminal 223 to the logic circuit 195. Upon receipt of a signal from the cigarette identifier system 50 indicating that a partially filled cigarette has been inserted into the cigarette receptacle 127, the logic circuit 195 sends a signal through terminal 225 to the puff-actuated sensor 45 to turn on the puff-actuated sensor so that puff-actuated power cycles may commence. The logic circuit 195 also sends a signal through terminal 227 to the indicator 51 to turn it on.

The logic circuit 195 includes a PROM (programmable read-only memory) 300, which includes preferably at least two data bases or "look-up tables" 302 and 304, and optionally, a third data base (look-up table) 306 and possibly a fourth look-up table 307 or more. Each of the look-up tables 302, 304 (and optionally 306, 307) converts a signal indicative of battery voltage $v_{in}$ to a signal indicative of the duty cycle ("$dc_1$" for the first phase and "$dc_2$" for the second phase) to be used in execution of the respective phase of the immediate power cycle. Third and fourth look-up tables 306 and 307 function similarly.

Upon initiation of a power cycle, the logic circuit receives a signal indicative of battery voltage $v_{in}$, and then references the immediate reading $v_{in}$ to the first look-up table 302 to establish a duty cycle $dc_1$ for the initiation of the first phase of the power cycle. The first phase is continued until the timing network 197 provides a signal indicating that the predetermined time period of the first phase $t_{phase\ 1}$ has elapsed, whereupon the logic circuit 195 references $v_{in}$ and the second look-up table 304 and establishes a duty cycle $dc_2$ for the initiation the second phase. The second phase is continued until the timing network 197 provides a signal indicating that the predetermined time period of the second phase $t_{phase\ 2}$ has elapsed, whereupon the timing network 197 provides a shut-off signal to the logic circuit 195 at the terminal 229. Optionally, the logic circuit 195 could initiate a third phase and establish a third duty cycle $dc_3$, and the shut-off signal would not be generated until the predetermined period of the third phase ($_{tphase\ 3}$) had elapsed. A similar regimen could optionally be established with a fourth phase ($t_{phase\ 4}$). The present invention could be practiced with additional phases as well.

Other timing network circuit configurations and logic circuits may also be used, such as those described in copending, commonly assigned U.S. Ser. No. 08/951,255 filed Oct. 16, 1997 (Attorney Docket PM 1782B), and the commonly assigned, U.S. Pat. Nos. 5,388,594; 5,505,214; 5,591,368; 5,499,636; and 5,372,148, all which are hereby incorporated by reference in their entireties.

When the logic circuit 195 receives a signal through terminal 221 from the puff-actuated sensor 45 that a sustained pressure drop or air flow has been detected, the logic circuit 195 sends a signal through terminal 231 to the timer network 197 to activate the timer network, which then begins to function phase by phase in the manner previously described. The logic circuit 195 also determines, by a downcount routine, which one of the eight heater elements is due to be heated and sends a signal through an appropriate terminal 211–218 to turn an appropriate one of the FET heater switches 201–208 ON. The appropriate heater stays on while the timer runs.

When the timing network 197 sends a signal through terminal 229 to the logic circuit 195 indicating that the timer has stopped running, the particular ON FET heater switch 211–218 is turned OFF, thereby removing power from the particular heater element 37. The logic circuit 195 also downcounts and sends a signal to the indicator 51 through terminal 227 so that the indicator will display that one less puff is remaining (e,g., "7", after the first puff). When the smoker next puffs on the cigarette 23, the logic circuit 195 will turn ON another predetermined one of the FET heater switches 211–218, thereby supplying power to another predetermined one of the heater elements. The process will be repeated until the indicator 51 displays "0", meaning that there are no more puffs remaining on the cigarette 23. When the cigarette 23 is removed from the lighter 25, the cigarette sensor 57 indicates that a cigarette is not present, and the logic circuit 195 is reset.

The cigarette marker 900 of the cigarette 23 and the cigarette identifier system 50 in the lighter 25 cooperate to establish a capacity in the circuit 41 to recognize that a cigarette has been inserted in the cigarette receptacle 127 and that it is of the correct type with which the lighter will function properly.

Inductance, generally speaking, includes the property of an electric circuit to be susceptible to exterior electromagnetic influences. Usually, inductive circuits can be used to generate rapidly changing and amplified electrical currents or for other electronic effects.

It is generally accepted that when a resistive load, e.g. a material which dampens the electromagnetic field near an inductive coil, is applied to an inductor, its Q (quality factor) is reduced. If the inductor is part of a Colpitts oscillator, the reduction in Q causes an increase in a control voltage which causes in turn an increase in bias current to compensate for increased losses in the reactive load. Utilizing this phenomenon, applicants have devised a novel method of identifying whether appropriate articles have been inserted into the lighter opening.

Depending on the nature of the product inserted into the inductive coil, the oscillator circuit may be chosen to have a frequency which will best amplify the inductive changes brought about by the correct article being inserted in the lighter. For example, the frequency may range from approximately 0.25 megahertz to about 30 megahertz. Printed inductive inks, such as the ink 906 in the cigarette 23' of FIG. 5, is best sensed at approximately 20 megahertz using the coil 1102 as previously described and a conventional cigarette diameter, whereas the foil 904 as previously described of the cigarette 23 of FIG. 4 is preferably sensed at approximately 1 megahertz using a conventional cigarette diameter.

It is clear to one of skill in the art, having regard for this disclosure, that several variables need to be considered when selecting the appropriate frequency, those factors including diameter of the coil 1102, number of turns in the coil 1102, the spacing between the turns, coil material, voltage and other factors, all which are to be considered when resolving the appropriate frequency. Analysis and/or testing of a prototype oscillator circuit 1106 across a range of frequencies will usually reveal which frequency of the oscillator circuit 1106 causes the impedence of the particular coil 1102 to peak, and the circuit 1106 is then tuned accordingly.

Figure 7:
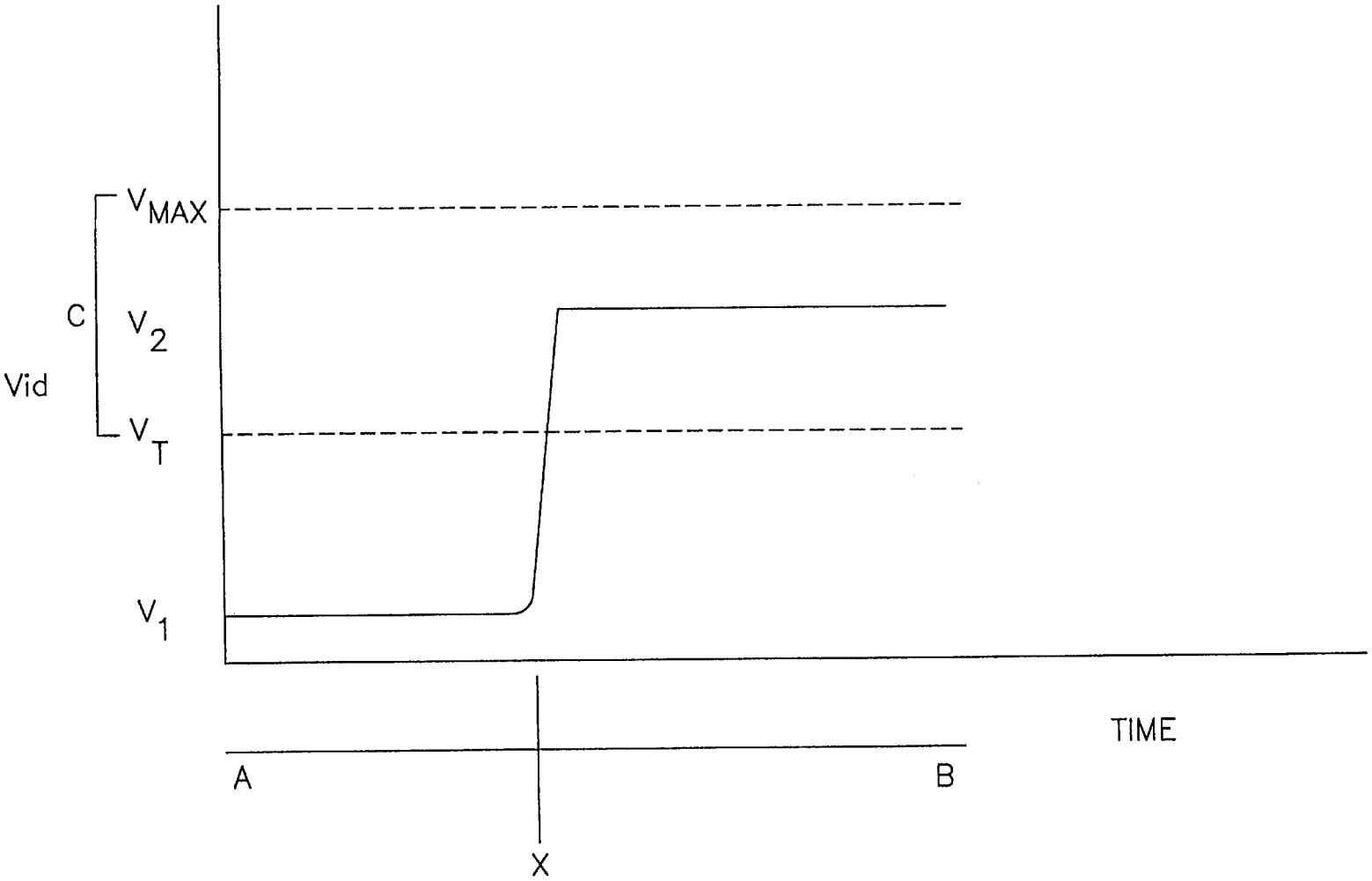
FIG. 7 is a graphical representation of the typical inductance circuit output versus time.

Referring to FIG. 7, the logic circuit 195 is preferably programmed to constantly monitor the output signal $v_{id}$ of the oscillator circuit 1106, preferably at a modulated rate that conserves power. Preferably, in the absence of a cigarette, the logic circuit 195 checks the output signal $v_{id}$ at a rate of 5 to 15 hertz, more preferably at approximately 8 hertz; whereas once detection initiates, the logic circuit 195 checks the output signal $v_{id}$ at 25 to 35 hertz, more preferably at approximately 31 hertz. Preferably, once insertion is detected, the logic circuit 195 confirms the initial reading with several, preferably three additional, consecutive readings before activating the lighter 25 for puff-actuated operation. The logic cicuit 195 is configured to compare the signal $v_{id}$ to both a predetermined threshold value ($v_{min}$) and a predetermined maximum value ($v_{max}$) that are preferably stored in the read only memory of the logic cicuit 195 (eprom or the like). The threshold minimum value is set sufficiently high, and the maximum value is set sufficiently low such that only proper items (e.g. an inductive marker 900) creates a signal $v_{id}$ that falls within the range C in FIG. 7 defined between $v_{min}$ and $v_{max}$. Receipt of such a signal causes the logic cicuit 195 to enable puff-actuated operation of the lighter as previously described.

During a first time-line portion A in FIG. 7, no items are sensed by the oscillator circuit 1106, indicating that no items having significant conductance (inductive effect) were inserted into the region of the coil 1102. At point X in FIG. 7, something is inserted into the lighter 25 which changes the measured value of $v_{id}$. If that change falls within the predermined range C during a second time-line portion B, the logic circuit 195 in effect accepts the inserted item as a genuine cigarette designed for use with the particular lighter 25. If the $v_{max}$ had been exceeded, e.g. by the insertion of a solid metal rod the size of a pencil, the logic circuit 195 would not recognize the item as genuine and would not allow operation of the lighter 25.

Figure 8:
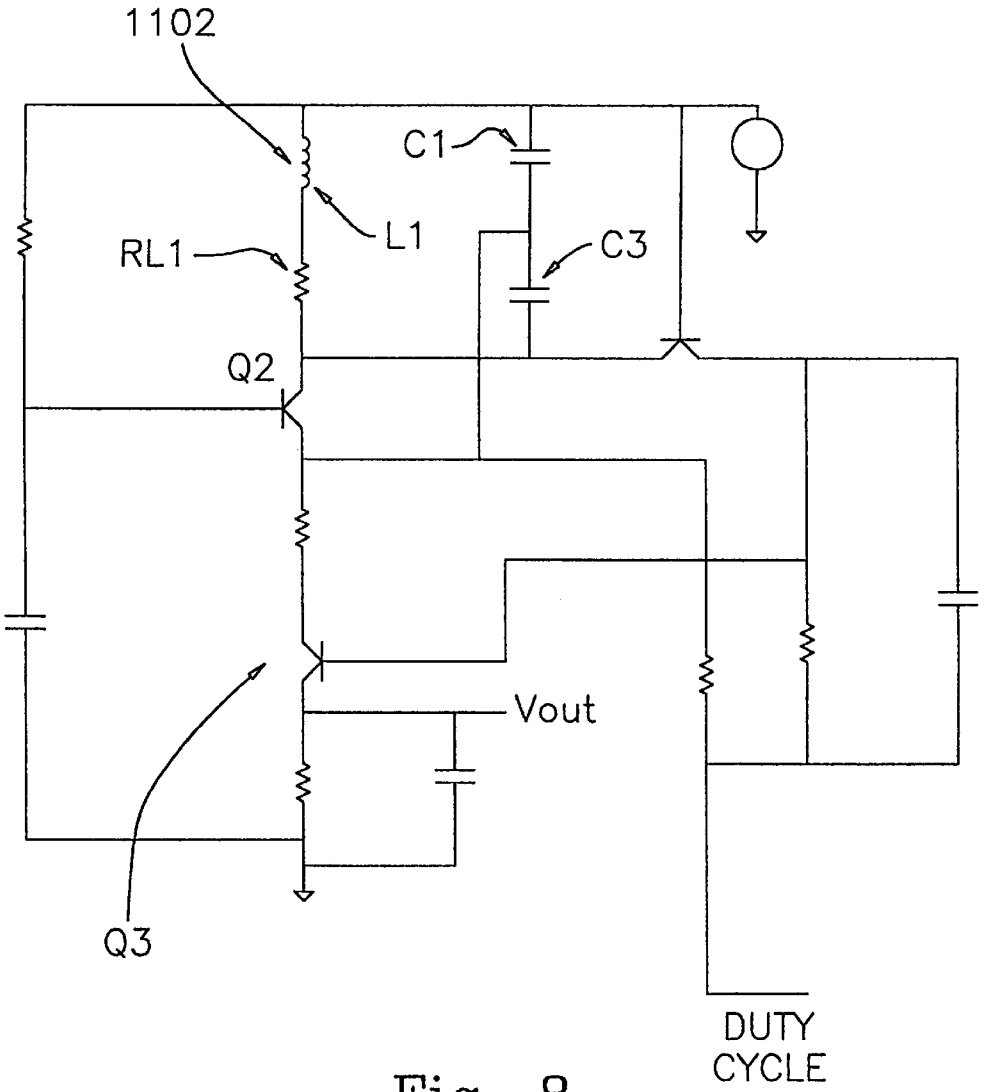
FIG. 8 is an electronic schematic of a circuit according to a preferred embodiment of the present invention.

A preferred operative circuit discussed above is illustrated in FIG. 8. It includes an oscillator circuit portion comprising the coil 1002 (L1 in FIG. 8), together with capacitors C1 and C3 and a transistor Q2. The effective resistance of the coil L1 is represented by the resistor RL1 in FIG. 8. The output of a current source Q3 is readable as $v_{id}$ which is a signal available for communication to the logic circuit 195. The preferred arrangement is operative as a Colpitts oscillator that operates at a predetermined frequency, preferably in the range of approximately 1 to 20 MHz to generate an output of 1.4 volts peak to peak (at OSC OUT in FIG. 8).

When a cigarette 23 is inserted so that an inductive (metallic) marker 900 is adjacent the coil 1102 (L1), the effective coil resistance (RL1) is changed, which in turn changes the coil's Q. When the Q is reduced, the amount of drive current required to sustain oscillation in the feedback portion of the circuit is increased. The current is sensed and converted to an output voltage $v_{id}$ that is usable to the logic circuit 195 of the lighter 25 to resolve that a marker-bearing cigarette 900 is present.

In the preferred circuit, the average collector current flowing out of the Q1 collector generates a voltage drop on R7. That voltage at R7 modulates the base of Q3 and adjusts the average current to the oscillator so as to keep the peak to peak voltage at the emitter of Q1 constant in amplitude.

Additionally, the current through R3 essentially flows through R10 as well and generates the output voltage $v_{id}$.

The duty cycle portion of the circuit comprises a CMOS logic level input.

There are several variants of this system which could work equally well. The foil may be placed inside or outside of the smoking article; and the coil may be mounted within the heater, or more preferably, in a lower temperature area proximate to the cigarette surface, such as in a sealing ring or gasket. In this case, the threshold must be carefully selected to be sensitive to a particular type of cigarette having construction to yield the appropriate Q in the inductance coil.

While this invention has been illustrated and described in accordance with preferred embodiments, it is recognized that variations and changes may be made therein without departing from the invention as encompassed in the claims. Although the above described cigarette marker 900, coil and circuitry of the cigarette identifier system are preferred, one skilled in the pertinent art would readily realize, upon familiarization with this disclosure, that other comparable components and tests may be constructed having entirely different values from those specifically provided above, yet by their proportions of values and other similarities provide functionally comparable effects, including provision for discerning the presence of an inductive marker at a location along a cigarette as has been taught herein. It is also contemplated that the invention may be applied to types of cigarettes other than a partially-filled cigarette.

What is claimed is:

1. An electrical smoking system comprising:

a cigarette including a component provided with a predetermined inductive marker; and an electric lighter comprising:

cigarette-receiving receptacle;

a cigarette identifier adapted to generate a signal indicative of presence of an inductive marker at a location along said cigarette-receiving receptacle; and a controller in communication with said cigarette identifier, said controller configured allow or disallow operation of said electric lighter upon receipt and processing of said signal.

2. An electrical cigarette lighter system, said lighter comprising a cigarette-receiving receptacle;

a cigarette identifier, said cigarette identifier configured to generate a signal indicative of a level of effective resistance of an inductor positioned at a location along said cigarette-receiving receptacle; and a controller in communication with said cigarette identifier, said controller configured allow or disallow operation of said electric lighter upon receipt and processing of said signal.

3. The system as claimed in claim 1 or 2, wherein the cigarette identifier comprises an induction sensor.

4. The system as claimed in claim 3, wherein the induction sensor comprises a coil, said coil having an interior and being connected to an oscillation circuit, said coil being configured to receive a cigarette into its interior.

5. The system as claimed in claim 4, wherein the oscillation circuit generates an output voltage signal which is sensed by the controller.

6. The system as claimed in claim 5, wherein the controller compares the sensed output voltage to a preset selected range of values and activates or deactivates the lighter in response to the results of the comparison.

7. The system as claimed in claim 1, wherein the cigarette comprises an inductive marker adapted to affect Q of an inductance coil at said location.

8. The system as claimed in claim 7, wherein the inductive marker is a metallic foil.

9. The system as claimed in claim 7, wherein the inductive marker is an inductive ink located upon a component of the cigarette.

10. The system as claimed in claim 7, wherein the inductive marker is a metallic tape.

11. An electrical smoking system as claimed in claim 8, wherein the foil is about 0.0005 inches thick.

12. The electrical smoking system as claimed in claim 3 wherein said cigarette identifier comprises an inductance coil concentrically disposed about said cigarette-receiving receptacle, said controller including means for detecting inductive changes at said inductance coil.

13. The system as claimed in claim 12 wherein said cigarette-receiving receptacle includes a receiver having a port arranged to slidingly receive a cigarette, said coil located concentrically about said port.

14. The system as claimed in claim 3, wherein said controller comprises an electronic control circuit, said electronic control circuit comprising:

an induction coil;

a constant voltage feedback loop connected to said induction coil; and a voltage output line in communication to said feedback loop, whereby variances in an effective resistance of the induction coil generate changes in the voltage output line.

15. The circuit as claimed in claim 14, wherein said feedback loop includes an oscillator having a frequency of approximately 1 to 20 megahertz.

16. A method of actuating a lighter of an electrical smoking system comprising the step of generating a control signal responsively to a change in signal indicative of a level of effective resistance of an inductor at a location along a cigarette receiving receptacle.

17. A cigarette including an inductive marker at a location along said cigarette.

18. A cigarette identifier system comprising a coil at a location along the cigarette-receiving receptacle of a lighter, an oscillation circuit in communication with the coil and a controller configured to activate or deactivate the lighter responsively to output of the oscillator circuit.

* * * * *